US005868235A

United States Patent [19]

Schwarzli

[11] Patent Number: 5,868,235

[45] Date of Patent: Feb. 9, 1999

[54] ROTARY COIN MECHANISM AND TOKEN THEREFOR

[75] Inventor: Josef W. Schwarzli, Stouffville, Canada

[73] Assignee: Machine-O-Matic Limited, Newmarket, Canada

[21] Appl. No.: 761,366

[22] Filed: Dec. 9, 1996

[51] Int. Cl.[6] ..... G07F 7/00; G07F 11/44

[52] U.S. Cl. ..... 194/212; 194/214; 194/255

[58] Field of Search ..... 194/212, 214, 194/255, 292; 40/27.5

[56] References Cited

U.S. PATENT DOCUMENTS

| | | | |
|---|---|---|---|
| 1,048,660 | 12/1912 | Clawson | 194/212 X |
| 1,175,623 | 3/1916 | Elliott | 194/212 |
| 1,180,993 | 4/1916 | Flowers . | |
| 1,189,385 | 7/1916 | Rhodes | 194/214 |
| 1,266,759 | 5/1918 | Atkinson . | |
| 1,335,966 | 4/1920 | Horsman . | |
| 1,869,387 | 8/1932 | McFarland . | |
| 2,008,416 | 7/1935 | Goetz . | |
| 2,038,837 | 4/1936 | Goetz . | |
| 2,133,250 | 10/1938 | Knee . | |
| 4,509,632 | 4/1985 | Jaffe . | |
| 4,651,862 | 3/1987 | Greenfield | 194/344 |
| 5,383,545 | 1/1995 | Schwarzli | 194/202 |

FOREIGN PATENT DOCUMENTS

| | | | |
|---|---|---|---|
| 2134296 A | 1/1984 | United Kingdom | G07F 7/00 |

*Primary Examiner*—F. J. Bartuska

*Attorney, Agent, or Firm*—Dimock Stratton Clarizio; Mark B. Eisen

[57] ABSTRACT

The invention provides a rotary coin mechanism in which the mechanism is provided with a boss which projects into the rotational path of the token. The boss allows rotation of the token carrier only if a token seated in the token receptacle is provided with a recess or groove complimentary to the boss and configured to approximate the rotational path of the token. In the preferred embodiment the groove has a first portion which is in line with the boss and a second portion which is offset from the first portion and connected thereto by a cam surface. As the token cycles past the boss, the boss passes from the first portion into the second portion of the groove and lifts the token within the token receptacle at the perimeter measuring point, so that only if the second portion of the groove is precisely positioned in the face of the token will the perimeter measuring device allow the token to pass. In a preferred embodiment the mechanism is also provided with a guide in the token receptacle comprising a pair of ribs compatible with one or more complimentary recesses or grooves in the token, to allow for insertion of the token. The preferred token thus has grooves in two directions: a first direction which is the direction of insertion of the token, and a second direction which is relatively orthogonal to the first and approximates the rotational path of the token as it is conveyed to the dispensing point by the token carrier. Also, in the preferred embodiment the grooves on opposite sides of the token are each formed deeper than one-half of the thickness of the token, so the points where these grooves intersect result in open spaces.

26 Claims, 8 Drawing Sheets

ROTARY COIN MECHANISM AND TOKEN THEREFOR

FIELD OF INVENTION

This invention relates to rotary coin mechanisms. In particular, this invention relates to a slug-resistant rotary coin mechanism adapted to accept a grooved token and to prevent rotation of the mechanism upon the insertion of a counterfeit token or slug.

BACKGROUND OF THE INVENTION

Rotary coin mechanisms are used widely for such devices as vending machines and the like. A typical example is a so-called "bulk vendor", colloquially known as a "gumball machine", which stores product in a product storage bin and dispenses the product upon rotation of the coin mechanism. One of many examples of such a bulk vendor is described in U.S. Pat. No. 5,383,545 to Schwarzli issued Jan. 24, 1995 for a "Coin Mechanism", which is incorporated herein by reference.

Bulk vendors are designed for self service by users with minimal maintenance, and as such are frequently placed in locations where their use cannot readily supervised. As a result bulk vendors are constantly subjected to attempts to steal merchandise.

The most common type of theft from bulk vendors involves the use of "slugs", which are usually disc-shaped pieces of metal, and more recently plastic and dense cardboard, approximating the size and configuration of the coin or token which the coin mechanism is designed to accept. Slugs composed of plastic or sturdy cardboard have recently become popular due to their low cost and the ease with which such slugs can be produced to the required size. This has led to the development of measuring devices with fairly precise tolerances, capable of determining the thickness and diameter of the inserted coin to within a few thousandths of an inch.

However, cardboard slugs in particular present a problem in bulk vendors, despite the precision of the measuring devices, because of the manner in which a conventional rotary coin mechanism discriminates between coins or tokens of the intended configuration and other coins, tokens or slugs. In a typical rotary coin mechanism a coin recess is provided in a rotating coin conveyor disc, and a pair of dogs respectively measure the thickness and diameter of the inserted coin or slug as the rotational cycle begins. Either dog will arrest rotation of the mechanism if the diameter or thickness does not match that of the intended denomination of coin. Such measuring devices are described in the aforementioned U.S. Pat. No. 5,383,545, and are generally effective in preventing rotation of the mechanism when a slug or incorrect denomination of coin is inserted.

However, in the case of slightly oversized cardboard slugs of the correct thickness, repeated attempts to force the mechanism to turn with the slug in the coin recess will result in gradual paring away of the edge of the slug by the perimeter measuring dog itself, and once the edge has worn to a point within the tolerance of the measuring dog, the mechanism will accept the slug. This "self-sizing" of cardboard slugs has become a significant problem resulting in extensive losses to bulk vendor operators.

It is known to provide a coin mechanism with ridges or ribs in the coin slot, which are adapted to allow only compatibly grooved tokens to be inserted into the coin recess. However, these suffer from the disadvantage that compatible grooves can often be easily filed into the face of a slug of the appropriate size. Moreover, in the case of cardboard and plastic slugs, which are somewhat flexible, the slug can be bent around the ribs in the coin slot which are intended to prevent the insertion of a coin or token that is not equipped with suitable grooves. In both cases the security offered by the ridges or ribs is defeated.

SUMMARY OF THE INVENTION

The present invention overcomes these disadvantages by providing a rotary coin mechanism in which the mechanism is provided with a boss which projects into the rotational path of the token as it is conveyed toward the dispensing point by the token carrier. The boss is stationary relative to the token carrier and allows rotation of the token carrier only if a token seated in the token receptacle is provided with a recess or groove complimentary to the boss and configured to approximate the rotational path of the token. This groove is therefore curvate, which makes it virtually impossible to file a similar groove into the face of a slug, and difficult even to mill such a groove with the required precision.

In the preferred embodiment this groove has a first portion which is in line with the boss when the token is properly seated in the token receptacle, and a second portion which is offset from the first portion and connected thereto by a cam surface. Thus, as the token cycles past the stationary boss and the boss passes from the first portion into the second portion of the groove, it lifts the token within the token receiving slot at the measuring point, ie. the point in the rotational path where the perimeter measuring dog measures the position of the periphery of the token. Only if the second portion of this groove is precisely positioned in the face of the token, so that the upper periphery of the token is raised to the predetermined level, at the correct point in the rotational cycle, will the perimeter measuring dog allow the token to pass so that rotation of the mechanism can continue to the dispensing position. This further increases the difficulty of filing or milling a suitable groove into the face of a counterfeit token.

In a preferred embodiment the mechanism is also provided with a guide comprising one or more ribs or projections in the token receptacle, compatible with complimentary recesses or grooves in the token, to allow for insertion of the token. When the mechanism of the invention is equipped with these projections, which rotate with the token carrier, as well as the boss, the compatible token must have grooves in two directions: a first direction which is the direction of insertion of the token, and a second direction which is substantially orthogonal to the first and approximates the rotational path of travel of the token as it is conveyed to the dispensing point by the token carrier.

Also, in the preferred embodiment the recesses or grooves in the token are each formed deeper than one-half of the thickness of the token. Thus, since some of the grooves are substantially orthogonal to one another, there are points where these intersect which leave open spaces. This prevents attempts to duplicate the token by bending a slug of sheet metal or another flexible material, because the ridges thereby created in the slug would interfere with grooves extending in the other direction.

The present invention thus provides a rotary coin mechanism comprising a rotatable token carrier having a token receptacle, for receiving a token and conveying the token about a rotational path commencing at a token insertion slot and terminating at a dispensing point, the token receptacle having a guide for maintaining the token in a designated orientation within the token receptacle, and a boss extending into the rotational path of the token, whereby when a token is seated in the token receptacle the boss allows rotation of the token carrier only when the token is provided with a groove through which the boss can pass as the token is conveyed past the boss.

The present invention further provides a token for use with a rotary coin mechanism comprising a rotatable token carrier having a token receptacle for receiving a token and conveying the token about a rotational path commencing at a coin slot and terminating at a dispensing point, and a boss extending into the rotational path of the token, the token having a groove extending across the body of the token through which the boss can pass as the token is conveyed past the boss so that the token carrier can be rotated about the rotational path when the token is seated in the token receptacle.

The present invention further provides, in combination, a rotary coin mechanism comprising a rotatable token carrier having a token receptacle, for receiving a token and conveying the token about a rotational path commencing at a token insertion slot and terminating at a dispensing point, the token receptacle having a guide for maintaining the token in a designated orientation within the token receptacle, the mechanism having a boss extending into the rotational path of the token, and a token having a groove extending across the body of the token through which the boss can pass as the token is conveyed past the boss, wherein the groove cooperates with the boss to allow rotation of the token carrier about the rotational path when the token is seated in the token receptacle.

These and other objects and advantages of the present invention will be apparent from the description of the preferred embodiment which follows.

BRIEF DESCRIPTION OF THE DRAWINGS

In drawings which illustrate by way of example only a preferred embodiment of the invention.

DETAILED DESCRIPTION OF THE INVENTION

The invention provides a rotary coin mechanism 10 and a token 2 therefor with security features that render a coin mechanism 10 of the invention particularly resistant to fraudulent operation by slugs and counterfeit tokens. It will be appreciated that as used herein the term "token" includes coins, checks, keys and the like, and the term "coin mechanism" includes any rotary mechanism for accepting tokens, coins, checks, keys and the like, and the invention is not intended to be limited by the terminology variously used for such devices in the prior art.

Figure 1:
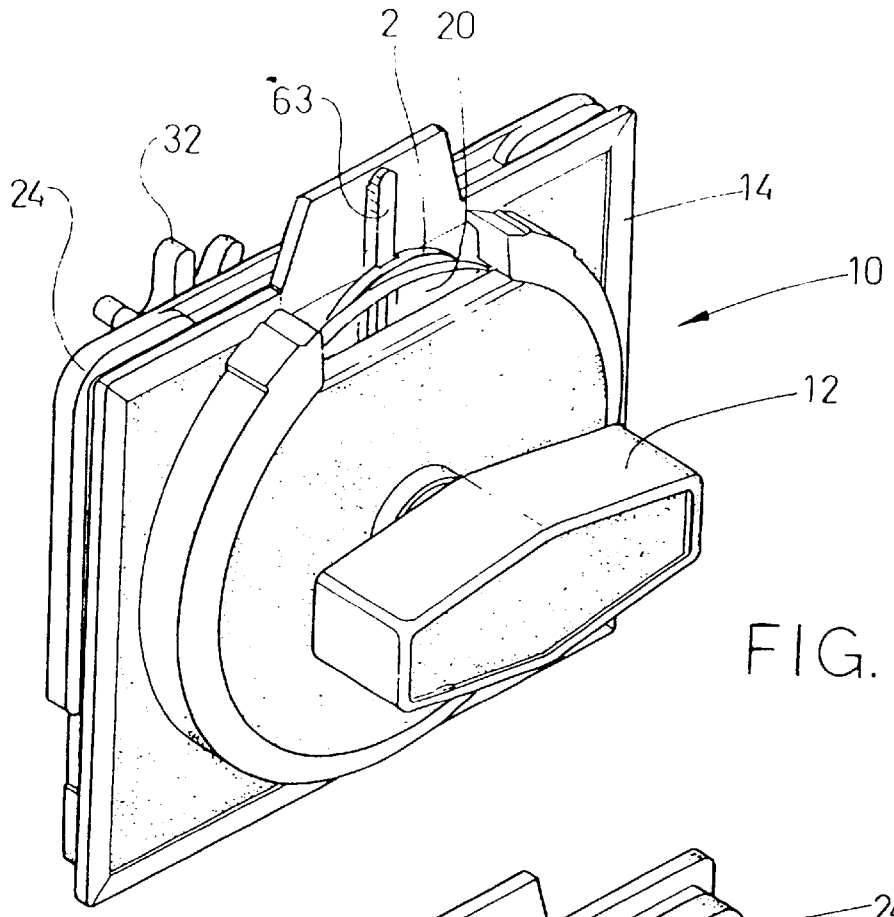
FIG. 1 is a front perspective view of a coin mechanism embodying the invention.
Figure 2:
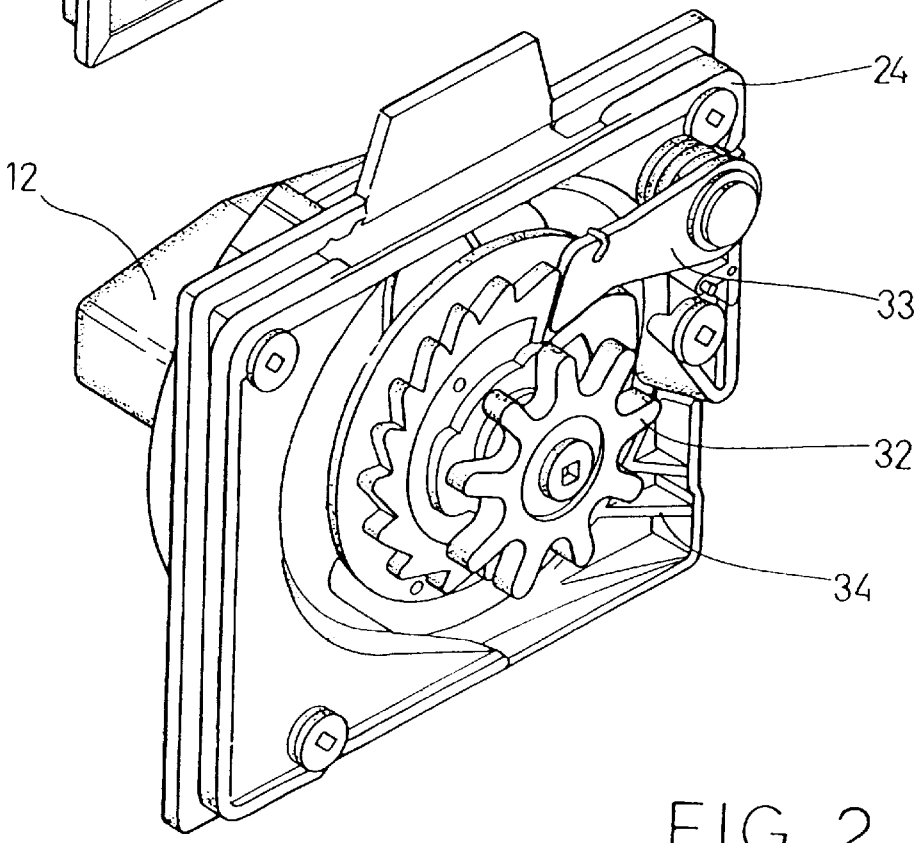
FIG. 2 is a rear perspective view of the coin mechanism of FIG. 1.
Figure 3:
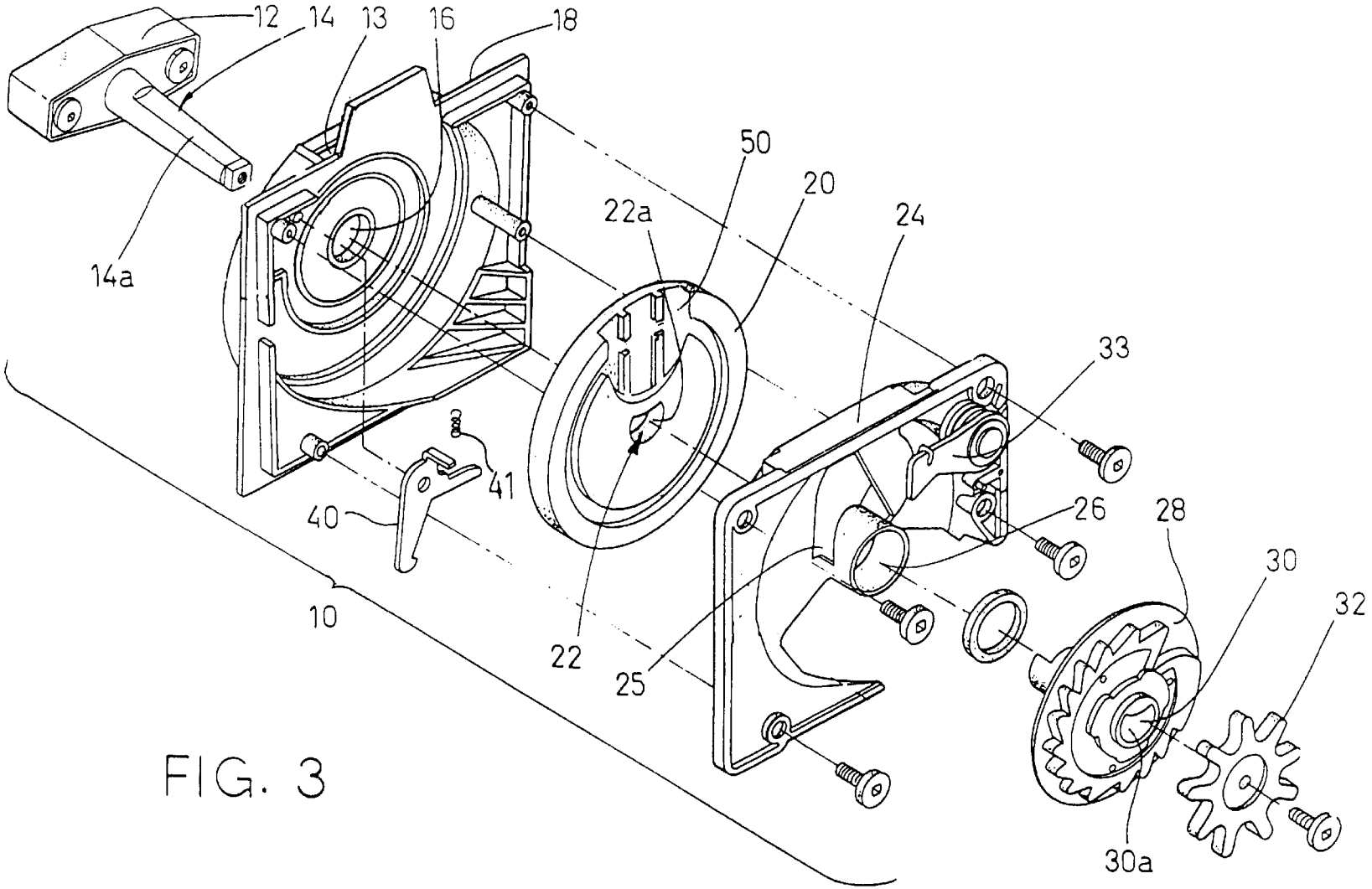
FIG. 3 is an exploded view of the coin mechanism of FIG. 1.

A preferred embodiment of the rotary coin mechanism 10 of the invention is illustrated in FIGS. 1 to 3. The coin mechanism 10 comprises a handle 12 with a shaft 14 that extends through a central opening 16 in the cover plate 18 providing a token insertion slot 13 for insertion of a token 2 into the mechanism 10. The shaft 14 extends through a central opening 22 in a token carrier 20, for receiving a token 2 in a token receptacle 50 and conveying the token 2 about a rotational path commencing beneath the token slot 13 and terminating at a dispensing ramp 34. The shaft 14 has a concave surface 14*a* complimentary to a convex surface 22*a* in the opening 22 through the token carrier 20, to rotationally lock the token carrier 20 to the shaft 14. The shaft 14 extends through a central opening 26 in a back plate 24, which is bolted to the cover plate 18 over the token carrier 20. The shaft 14 extends through a central opening 30 in a ratchet gear 28, the opening 30 having a convex surface 30*a* complimentary to the concave surface 14*a*, to rotationally lock the ratchet gear 28 to the shaft 14, and a dispensing gear 32 is bolted to the square end of the shaft 14 and rotationally locked thereto by a square recess (not shown) within which the end of the shaft 14 nests.

As the handle 12 is rotated, the token carrier 20 conveys the token 2 about a rotational path to a dispensing point defined by a dispensing ramp 34 formed in the cover plate 18, where the token 2 falls into a collection bin (not shown); at the same time, the dispensing gear 32 meshes with the toothed edge of a revolving dispensing wheel (not shown), to turn the dispensing wheel and thereby bring a product compartment in alignment with a dispensing chute (not shown) to dispense merchandise to the user. The ratchet gear 28 cooperates with a pawl 33 to prevent the mechanism 10 from being rotated in the reverse direction, so that only a single load of merchandise can be dispensed with each complete rotation of the handle 12. The basic structure and operation of the coin mechanism 10 of the invention described thus far is well known to those skilled in the art.

The invention provides a boss 70, which in the preferred embodiment projects from the cover plate 14, extending into the rotational path of the token 2. The boss 70 allows the token carrier 20 to be rotated only when the token 2 seated in the token receptacle 50 is provided with a groove 80 through which the boss 70 can pass as the token 2 is conveyed past the boss 70.

Figures 5, 5A:
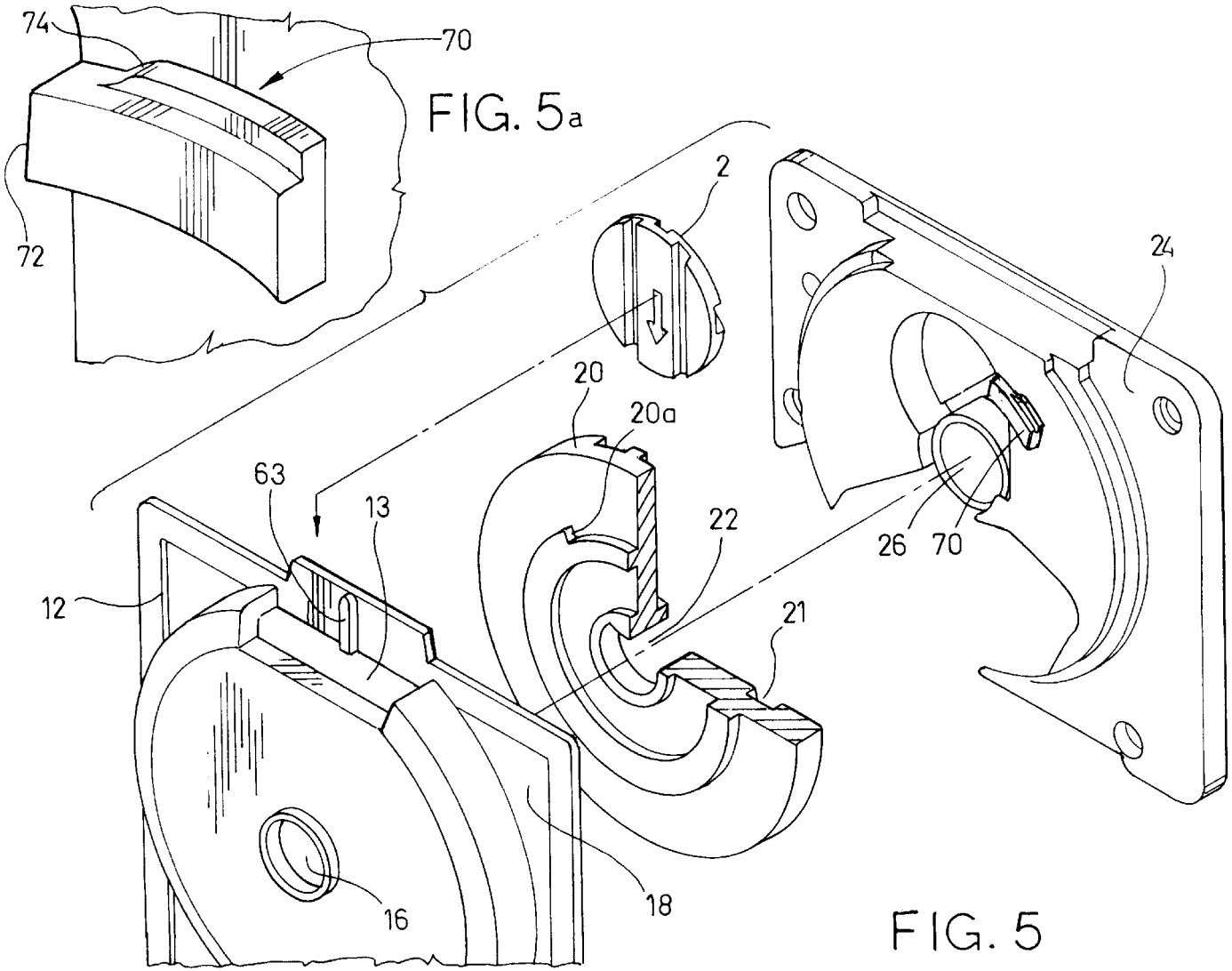
FIG. 5 is a partially cutaway exploded view of the coin mechanism of FIG. 1 showing the positioning of the boss.
FIG. 5*a* is an enlarged perspective view of the boss of FIG. 5.
Figure 6:
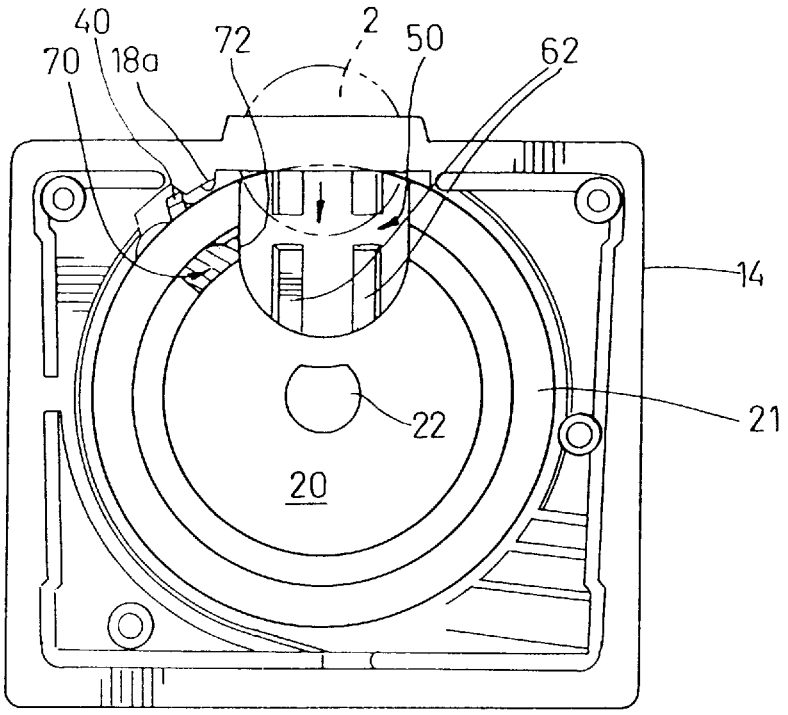
FIG. 6 is a rear elevation of the cover plate and token carrier of the coin mechanism of FIG. 1, showing the manner of inserting a token into the token receptacle.

The boss 70 is illustrated in FIGS. 5 and 5*a*. The boss 70 projects from the back plate 24 into the rotational path of a token 2 seated in the token receptacle 50, as shown in FIG. 6. The face 2*a* of the token 2 is provided with a groove or recess 80 through which the boss 70 passes as the carrier 20 is rotated. Thus, if a token or slug seated in the token receptacle 50 does not have a suitable groove 80, the token carrier 20 cannot be rotated because face 72 of the boss 70 will block the path of the token when the user tries to rotate the handle 12.

This prevents the problem of the self-sizing slug inherent in prior art coin mechanisms, whereby the perimeter measuring device pares the edge of the slug through repeated rotation of the handle 12 until the perimeter measuring device reaches the release position and allows the slug to pass; the boss 70, being preferably disposed immediately adjacent to the leading edge of the token receptacle 50 in the neutral position, will prevent rotation of the token carrier 20 at the beginning of the rotational cycle, so the slug will never come into contact with the perimeter measuring device.

In the preferred embodiment the face 72 is provided with one or more sharp edges, like a punch or die, so if a user attempts to rotate the mechanism 10 using a plastic or cardboard slug the face 72 will cut into or shred the slug. The token receptacle 50 may be formed with a bevelled lower edge 50*a* to facilitate dislodgement of pieces of the slug from the token receptacle 50.

Because the rotational path of the token 2 is arcuate, the groove 80 is curvate. This makes it virtually impossible to produce a compatible groove by filing a counterfeit token using an ordinary file. To further enhance this security feature, in the preferred embodiment the groove 80 is formed from two portions: a first groove portion 80*a* extending into an intermediate position in the token from the leading edge (relative to the direction of rotation of the token carrier 20) of the token 2, and a second groove portion 80*b* extending from the end of the first portion 80*a* to the trailing edge of the token 2.

Figure 4:
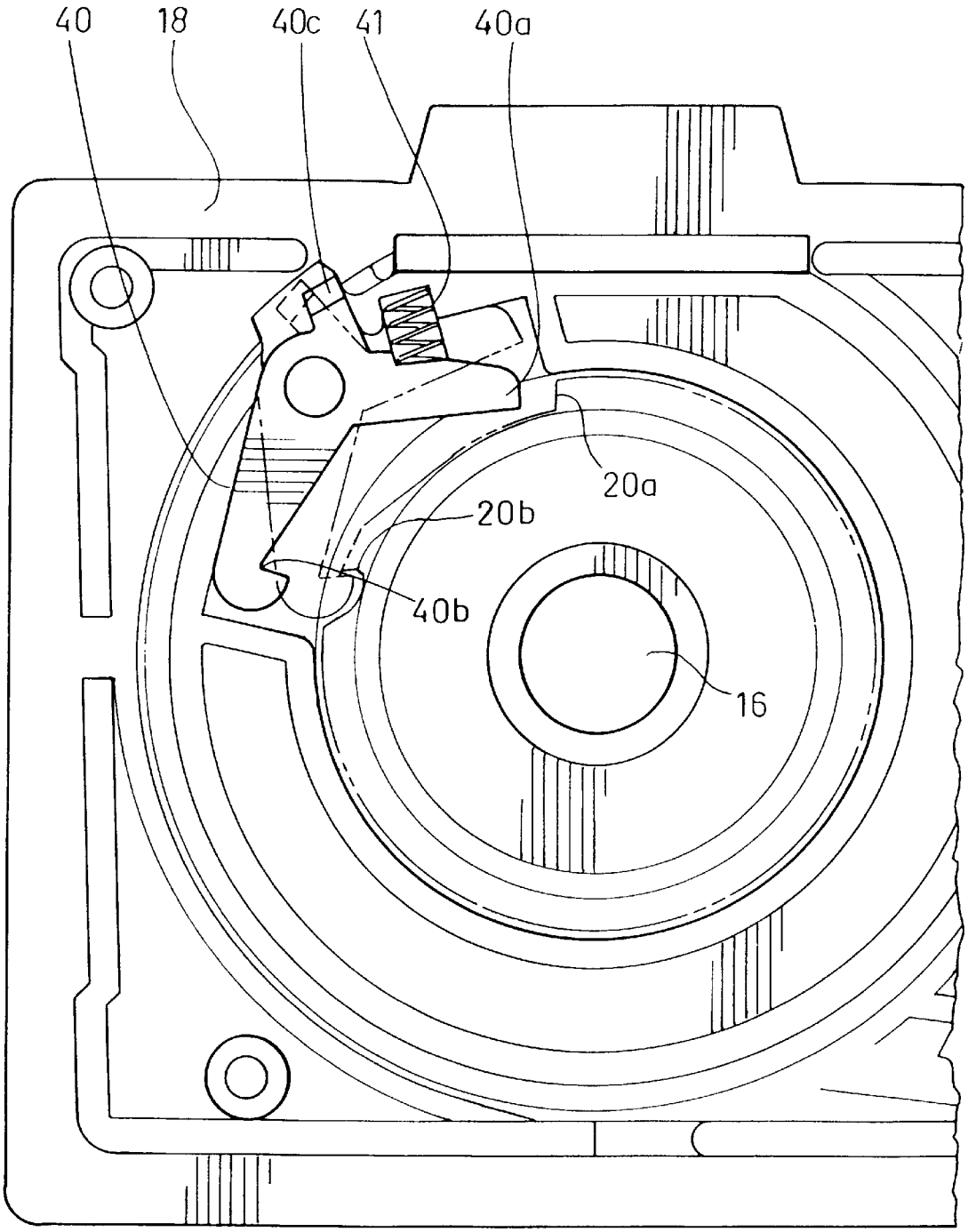
FIG. 4 is a rear elevation of the cover plate of the coin mechanism of FIG. 1 showing the two limits of the perimeter measuring dog.

In this embodiment the groove portions 80*a*, 80*b* operate in conjunction with the perimeter measuring device, comprising a measuring dog 40 pivotally mounted inside the cover plate 14. The dog 40 pivots between a rest position, shown in solid lines in FIG. 4, and a raised position, shown in phantom lines in FIG. 4. The dog 40 is biased to the rest position by a spring 41, in which position an arm 40*a* lies in the path of a catch 20*a* on the front face of the token carrier 20 (see also FIG. 5) and prevents the token carrier 20 from rotating. The dog 40 is positioned so that when a token 2 is inserted into the token receptacle 50, the perimeter of the token 2 must contact a finger 40*c* to raise the dog 40. In prior art coin mechanisms utilizing this configuration of dog 40, a coin of the correct diameter raises the dog 40 to the release point, ie. just enough so that the arm 40*a* clears the catch 20*a*. However, if the coin is oversized the perimeter of the token 2 will contact the finger 40*a* and raise the dog 40 beyond the release point, so that the hook 40*b* locks into another catch 20*b*, as shown in phantom in FIG. 4, again preventing the carrier 20 from rotating. In this fashion the perimeter measuring device allows rotation of the token carrier 20 only when a coin of the designated diameter is inserted into the mechanism 10. This perimeter measuring device is described in detail in the aforementioned U.S. Pat. No. 5,383,545 to Schwarzli.

Figure 8A:
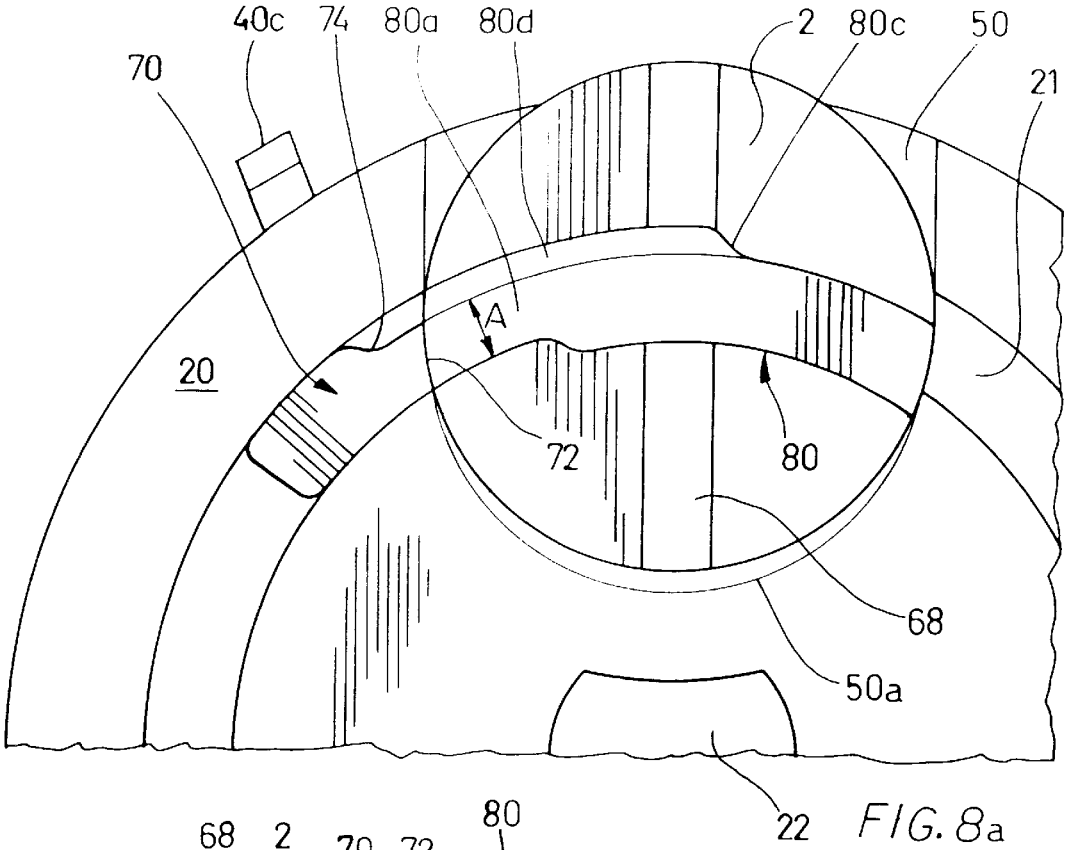
FIG. 8*a* is an enlarged rear elevation of the token receptacle of FIG. 6 showing the token carrier in the rest position.
Figure 8B:
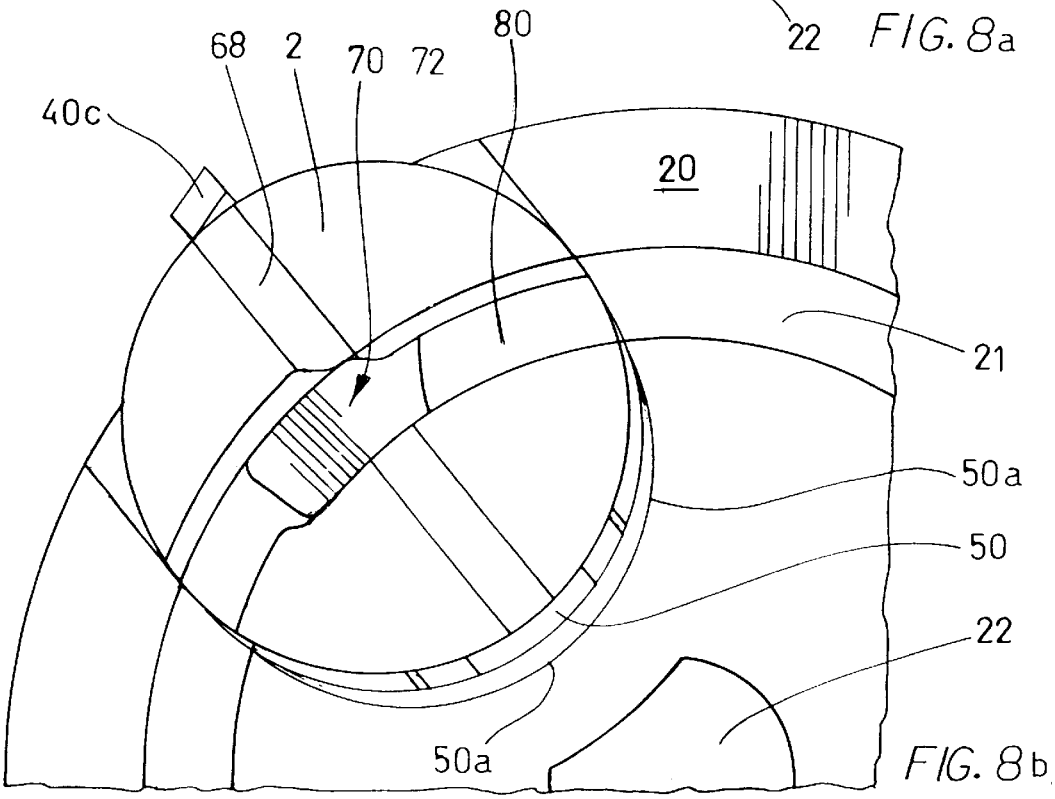
FIG. 8*b* is an enlarged rear elevation of the token receptacle of FIG. 6 showing the token carrier at the perimeter measuring point.

In the preferred embodiment of the present invention, the first groove portion 80*a* is in alignment with the boss 70 when the token is seated in the token receptacle 50. The second groove portion 80*b* is slightly offset from the first groove portion 80*a* such that the groove portion 80*b* is lower than the groove portion 80*a*, as can be seen in FIG. 8*a*. The first groove portion 80*a* merges into the second groove portion 80*b* via a smooth cam surface 80*c*. The boss 70 is provided with a cam 74. Thus, as the token 2 cycles past the boss 70, the cam 74 on the boss 70 contacts the cam surface 80*c* in the groove 80 and the token 2 is lifted within the token receptacle 50, as illustrated in FIG. 8*b*. The dog 40 is designed and positioned so that the token 2 will contact the finger 40*c* and lift the dog 40 to the release position at precisely the point in the rotational cycle of the token carrier 20 at which the token 2 is lifted by the cam 74 in this fashion.

Figure 7:
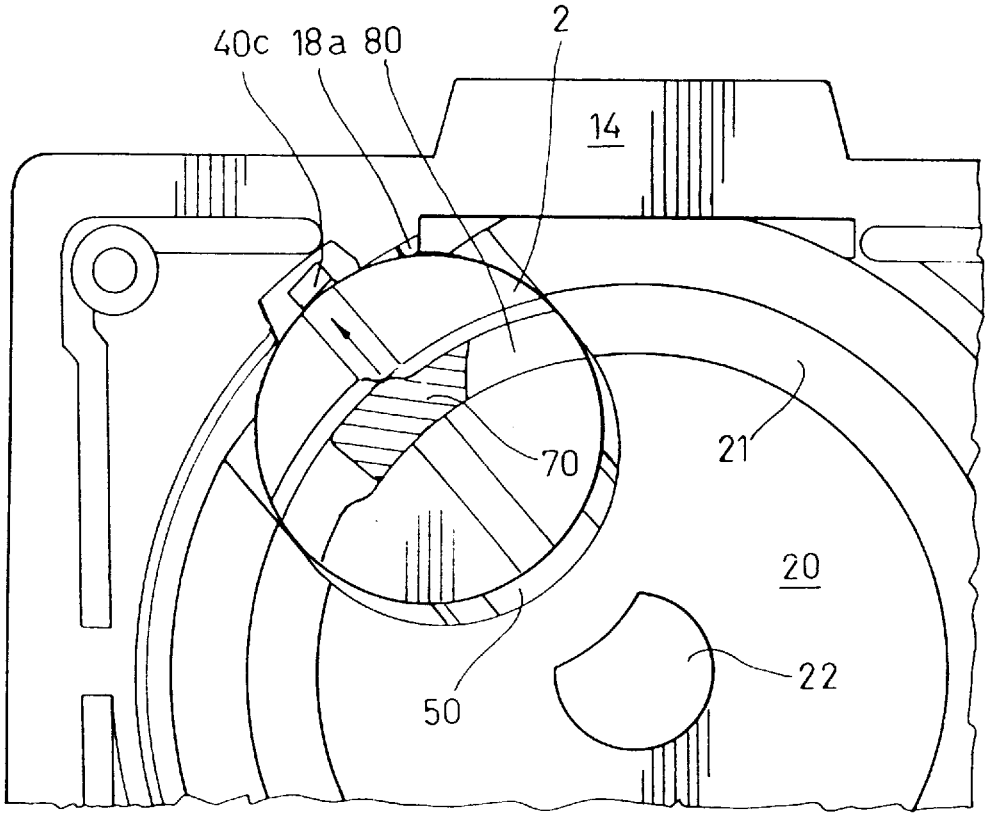
FIG. 7 is an enlarged rear elevation of the token receptacle of FIG. 6 at the perimeter measuring point.

A protuberance 18*a* projecting rearwardly from the cover plate 18, best seen in FIG. 7, prevents the token 2 from being lifted prematurely. Thus, in this embodiment of the invention the token 2 must have both a correctly positioned first groove portion 80*a* in alignment with the boss 70, to allow the token carrier 20 to rotate at all, and, commencing at the proper point intermediate to the face 2*b* of the token 2, a second groove portion 80*b* offset from the first groove portion 80*a* to precisely the correct degree, to raise the dog 40 to the release position at the correct point in the rotational cycle. This makes it extremely difficult to mill a groove of the correct configuration into a counterfeit token or slug.

The cam 74 is formed to only a portion of the depth of the boss 70, as can be seen in FIG. 5*a*, to maximize the shearing ability of the face 72. A ledge 80*d* formed in the groove 80 serves to guide the cam 74 along the groove 80, and for the same reason the portion of the projection 70 extending beyond the cam 74 is preferably dimensioned as closely as possible to the span "A" (see FIG. 8*a*) of the groove 80.

In the preferred embodiment shown the token receptacle 50 is a recess formed in the rear face of the token carrier 20, deep enough that the token 2 sits in the token receptacle 50 approximately flush with the rear face of the token carrier 20. Thus the boss 70, in order to project into the rotational path of the token 2, must accordingly project into the space occupied by the token carrier 20; the token carrier 20 is therefore provided with a groove 21 through which the boss 70 passes as the carrier 20 is rotated. The token carrier 20 could be made thinner, as in the embodiment of FIG. 13*a*, or a ledge or a pair of opposed pins or bosses (not shown) upon which the token 2 sits could be provided as a token receptacle 50 instead of a recess, in which case the groove 21 in the token carrier 20 would be unnecessary.

In a preferred embodiment a guide 60 is disposed in the token receptacle 50, to ensure that the token 2 is retained in the correct orientation (ie. with the groove 80 aligned with the boss 70) as the rotational cycle commences. Preferably the guide 60 comprises a pair of ribs 62, but the guide 60 could equally be formed as a single rib 62, or any other shape of projection, so long as a complimentary recess or groove 66 in the face 2*b* token 2 is configured with a sufficient width and depth to accommodate the guide 60. However, in that only a token 2 with one or more grooves 66 complimentary to the guide 60 can be inserted into the token receptacle 50, the use of two ribs 62 and two complimentary grooves 66 in the token is more likely to defeat attempts to use slugs.

Figure 11:
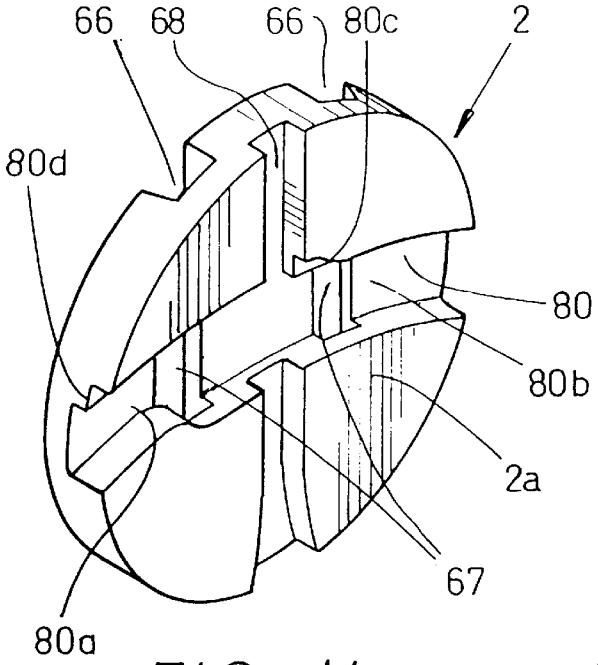
FIG. 11 is a perspective view taken opposite FIG. 10.

For increased security, another rib 63 may be positioned above the token insertion slot 13, as illustrated in FIG. 1, in which case a complimentary groove 68 (preferably flared slightly at the bottom to facilitate insertion of the token 2) is formed in the face 2*a* of the token 2, as shown in FIG. 11. To ensure that the token 2 cannot be inserted upside down (which would prevent the groove 80 from properly aligning with the boss 70) the rib 63 in this embodiment is disposed slightly offset from the center of the token receptacle 50 in the rest position. However, the rib 63 not being essential to the invention, if it is omitted then the ribs 62 should be disposed non-symmetrically within the token receptacle 50, for the same reason.

In the preferred embodiment the ribs 62 each comprise two components 62*a*, 62*b*, separated by a clearance 62*c* (for reasons described below). It will be appreciated that the grooves 66 need not extend across the entire face 2*a* of the token 2; it would be sufficient, for example, to omit the upper components 62*b* of the ribs 62, in which case the complimentary grooves 66 in the token 2 would only have to extend to the level of the groove 80. However, it is advantageous to extend the ribs 62 fully across the token receptacle 50, since this restricts as much as possible any rotational movement of the token 2 within the receptacle 50 (the components 62*b*, which can be seen by a user, also serve as a visual indicator of the orientation in which the token 2 should be inserted).

Figure 12:
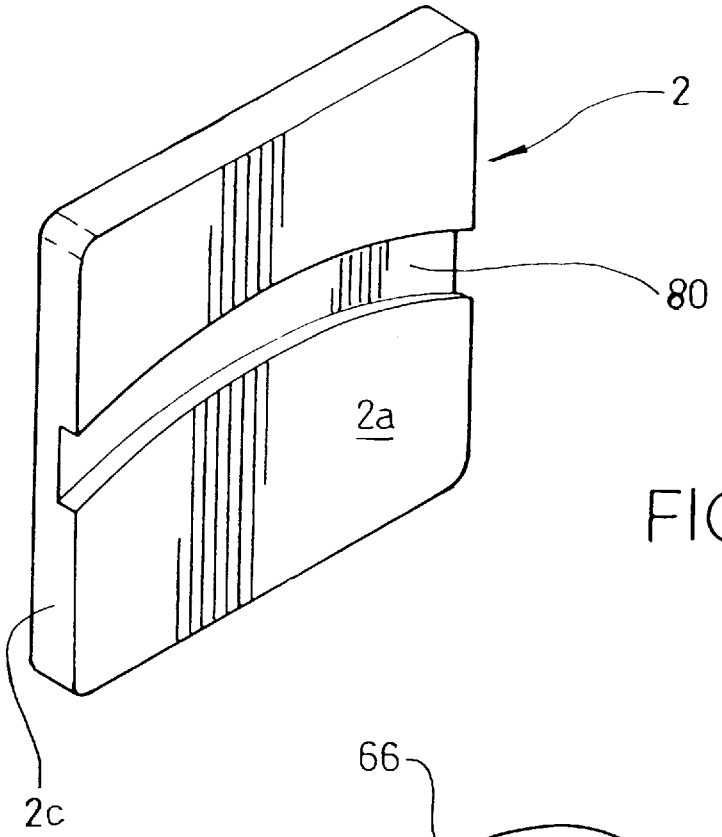
FIG. 12 is a perspective view of a further embodiment of the token of the invention.
Figure 13:
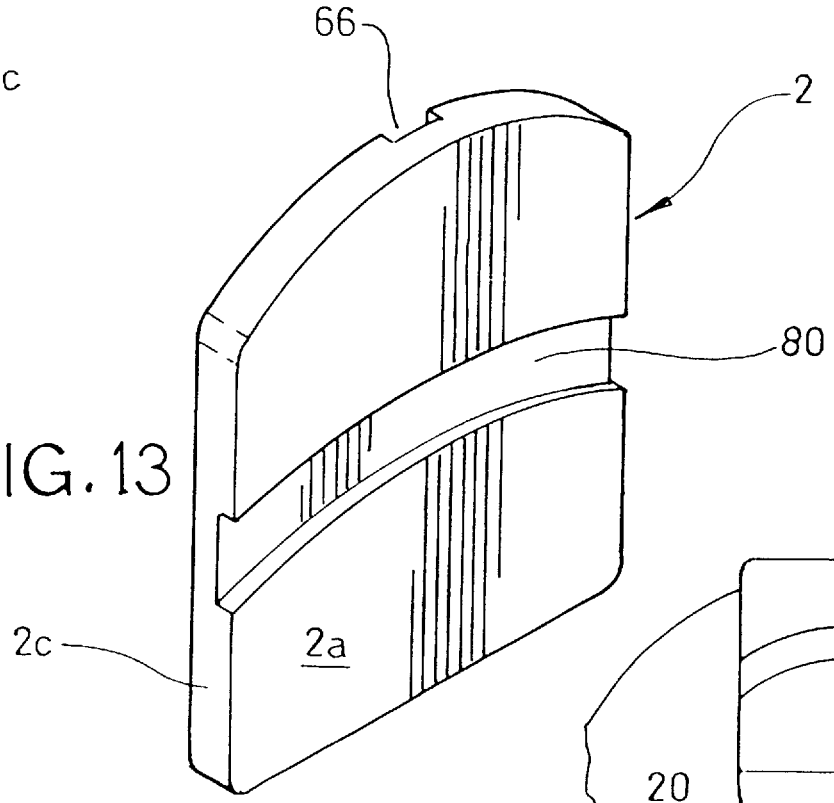
FIG. 13 is a perspective view of a still further embodiment of the token of the invention.
Figure 13A:
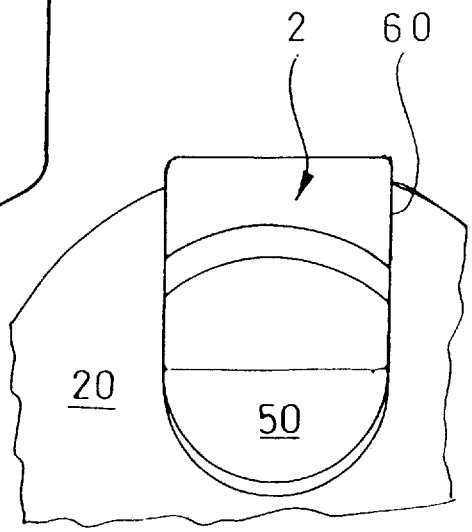
FIG. 13*a* is an elevation of the token of FIG. 12 seated in the token receptacle.

Since the guide 60 serves primarily to prevent the token 2 from rotating within the token receptacle 50, and thus to ensure that if the proper token 2 is inserted into the mechanism the groove 80 will properly align with the boss 70, it will be apparent that if a single projection is used as the guide 60 it should be either elongated or offset from the center of the token receptacle 50 (or both), to prevent rotation of the token 2 within the token receptacle 50. However, it will also be appreciated that this function of the ribs 62, as a means for maintaining the orientation of the token 2 within the token receptacle 50, is only required for a completely disc-shaped token 2. The token 2 may be formed to any shape, for example rectangular as in the embodiments of FIGS. 12 and 13, and as such can be provided with a straight edge portion 2*c* which could equally be used as means for maintaining the orientation of the token 2 within the token receptacle 50; in this case a straight edge of the token receptacle 50 could function as the guide 60, as shown in FIG. 13*a*, and a rib 62 or other projection need be provided within the token receptacle 50 only if desired to make the configuration of the token 2 more complex for purposes of resistance to slugs and counterfeit tokens.

Figure 10:
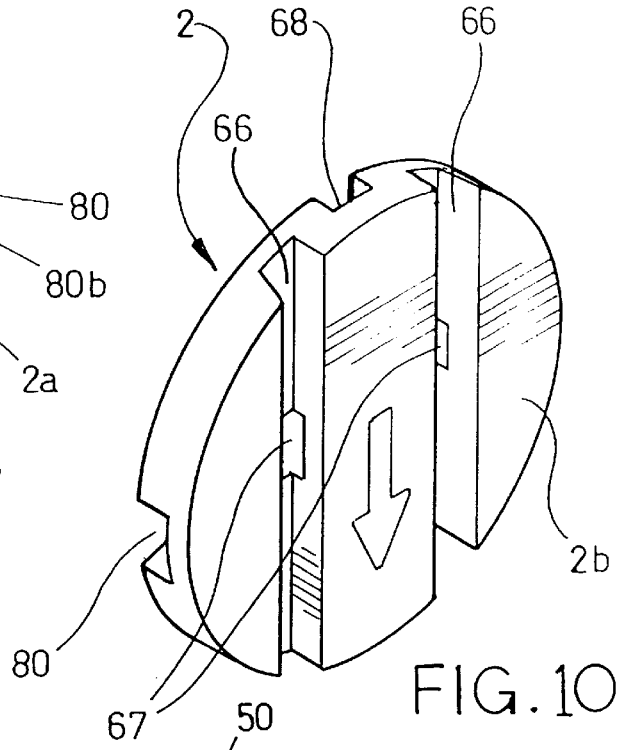
FIG. 10 is a perspective view of one preferred embodiment of the token of the invention.
Figure 9:
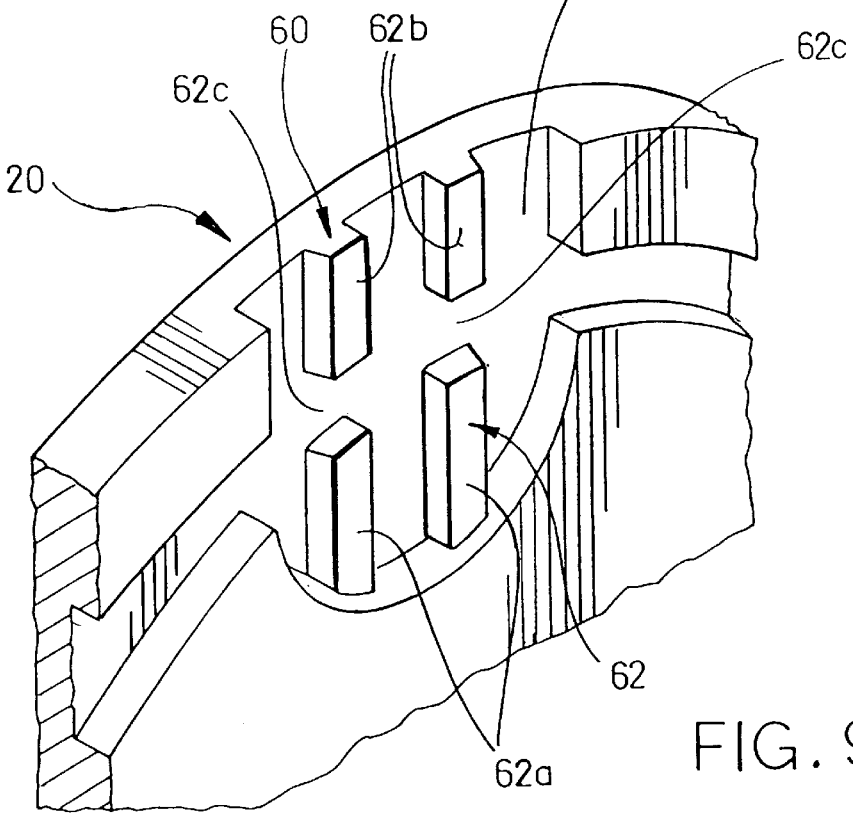
FIG. 9 is an enlarged partial perspective view of the token carrier showing the projections in the token receptacle.

In the preferred embodiment of the token 2, the grooves 66 and 80 are formed deeper than one half of the thickness of the token 2, as shown in FIGS. 10 and 11. Thus, at the point of intersection of the grooves 66 and groove 80, ie. where the floors of the grooves 66 and groove 80 overlap, there will be an opening 67. This makes it very difficult to reproduce the token 2 out of sheet metal. However, since the boss 70, which is dimensioned to project fully to the floor of the groove 80, will then project beyond the limits of the ribs 62, the groove 21 in the token carrier 20 must be continued through the ribs 62, in the form of openings or clearances 62*c* between the components 62*a*, 62*b* of each rib 62, so that the token receptacle 50 can cycle past the boss 70. This is the sole purpose of the clearances 62*c*, which become unnecessary if the boss 70 and/or the ribs 62 are formed to a smaller depth.

The operation of the preferred embodiment is as follows: A token 2 is inserted into the token slot 13 by a user, who orients the token so that the groove 68 is aligned with the rib 63. The grooves 66 slide over the ribs 62 as the token 2 is inserted so that the token 2 seats fully in the token receptacle 50, at which point the groove 80 is in alignment with the boss 70. As the user rotates the handle 12, the token carrier 20 rotates out of the neutral position and the boss 70 passes through the first portion 80*a* of the groove 80. As the cam 74 on the boss 70 contacts the cam surface 80*c* in the groove 80, the token 2 is lifted and contacts the finger 40*c* of the dog 40, lifting the dog 40 to the release position. The boss 70 passes out of the groove portion 80*b* and token 2 has now passed the security features of the mechanism, so rotation of the handle 12 can continue freely through a complete dispensing cycle. As the token 2 reaches the dispensing ramp 34 it is released from the token receptacle 50 in the token carrier 20 and falls into a token collection bin (not shown).

If a user attempts to insert a slug or counterfeit token into the mechanism, one of the following occurs:

1. If a rigid (plastic or metal) slug or counterfeit token does not have suitably configured and positioned grooves 66 and/or 68, the slug or token cannot be inserted into the token receptacle 50 and the perimeter measuring dog 40 will thus prevent rotation of the handle 12 beyond the measuring point in the rotational cycle of the token carrier 20.
2. If a flexible (plastic or cardboard) slug or counterfeit token does not have suitably configured and positioned grooves 66 and/or 68, the slug or token must be bent around the ribs 62, 63, which will create vertical ridges in the face of the slug or token that will preclude a groove 80 from extending across the face in a substantially perpendicular orientation, and the slug or token will thus be blocked by the boss 70.
3. If a slug or counterfeit token does not have a suitably configured and positioned groove 80 extending across the entire slug token, as the user rotates the handle 12 the slug or token will be sheared across the middle by the shearing face 72 of the boss 70, and the pieces of the slug or token will eventually fall through the undersized token opening 25 in the back plate 24.
4. If a slug or counterfeit token does have suitably configured and positioned grooves 66 and/or 68, and the groove 80, as the user rotates the handle 12 the perimeter measuring dog 40 will measure the upper periphery of the slug or token at the measuring point. If the slug or token is not of the correct diameter, the dog 40 will arrest rotation of the token carrier 20 at the measuring point. In the embodiment in which the mechanism 10 is designed to accept a token 2 with a groove 80 formed in two offset portions 80*a*, 80*b*, if the slug or token has only a single aligned groove 80 the slug or token will not be lifted at the measuring point and the dog 40 will arrest rotation of the mechanism as though the slug or token were undersized.

It can thus be seen that the complimentary boss 70, particularly when combined with ribs 62 or like projections, will make it difficult to defeat the coin mechanism 10 of the invention because of the difficulty in reproducing these features into a counterfeit token or slug. It will be appreciated that: the exact positioning, configuration, depth and number of ribs 62 (if any) and complimentary grooves 66 in the token 2 is largely a matter of choice, except as may be expressly limited by the above description; the ribs 62 and the boss 70 operate independently and, although advantageous for the reasons described above, it is not essential that both of these features be provided so long as some guide means 60 is provided to ensure that the token 2 retains the proper orientation within the token receptacle 50; forming the groove 80 in two offset portions, so that the token 2 is lifted as the boss 70 cams past the cam surface 80*c* in the groove 80, provides added security, but the invention could equally be implemented with a groove 80 which is aligned in its entirety with the boss 70 (as in the embodiments of FIGS. 12 and 13). The invention has been described by way of the preferred embodiment and is not intended to be limited in any of these respects, other than as expressly limited by the appended claims, and is intended to include all modifications and adaptations as fall within the scope of the appended claims.

I claim:

1. A rotary coin mechanism comprising a rotatable token carrier having a token receptacle, for receiving a token and conveying the token about a rotational path commencing at a token insertion slot and terminating at a dispensing point, the token receptacle having a guide for maintaining the token in a designated orientation within the token receptacle, the guide comprising one or more ribs aligned in a direction of insertion of the token, and a boss extending into the rotational path of the token, whereby when a token is seated in the token receptacle the boss allows rotation of the token carrier only when the token is provided with a groove through which the boss can pass as the token is conveyed past the boss.

2. The mechanism of claim 1 in which the one or more ribs consist of two portions separated by a clearance to allow the guide to pass therethrough.

3. The mechanism of claim 2 including a pair of ribs.

4. The mechanism of claim 1 in which a rib is disposed above a token insertion slot in communication with the token receptacle.

5. The mechanism of claim 1 in which the groove comprises a first groove portion in alignment with the boss and a second groove portion offset from the first groove portion and connected thereto by a cam surface, whereby as the boss passes from the first groove portion to the second groove portion the boss lifts the token at a point of measurement by a perimeter measuring device.

6. The mechanism of claim 1 in which the boss is provided with a sharp edge facing the token.

7. The mechanism of claim 1 in which the token has a straight edge and the guide comprises a straight edge of the token receptacle.

8. A token for use with a rotary coin mechanism comprising a rotatable token carrier having a token receptacle for receiving a token and conveying the token about a rotational path commencing at a coin slot and terminating at a dispensing point, and a boss extending into the rotational path of the token, the token having one or more grooves extending across a first face of the token aligned in a direction of insertion of the token, one or more grooves extending across a second face of the token opposite to the first face and intersecting with said one or more grooves aligned in a direction of insertion of the token, through which the boss can pass as the token is conveyed past the boss so that the token carrier can be rotated about the rotational path when the token is seated in the token receptacle, wherein at least one of the grooves is formed deeper than one half of the thickness of the token such that openings are formed at points where the grooves intersect.

9. The token of claim 8 in including two grooves aligned in a direction of insertion of the token.

10. The token of claim 8 in which the groove comprises a first groove portion in alignment with the projection and a second groove portion offset from the first groove portion and connected thereto by a cam surface, whereby as the projection passes from the first groove portion to the second groove portion the projection lifts the token at a point of measurement by a perimeter measuring device.

11. A rotary coin mechanism comprising a rotatable token carrier having a token receptacle, for receiving a token and conveying the token about a rotational path commencing at a token insertion slot and terminating at a dispensing point, the token receptacle having a guide for maintaining the token in a designated orientation within the token receptacle, and a boss extending into the rotational path of the token, wherein when a token is seated in the token receptacle the boss allows rotation of the token carrier only when the token is provided with a groove through which the boss can pass as the token is conveyed past the boss, the groove comprising a first groove portion in alignment with the boss and a second groove portion offset from the first groove portion and connected thereto by a cam surface, whereby as the boss passes from the first groove portion to the second groove portion the boss lifts the token at a point of measurement by a perimeter measuring device.

12. The mechanism of claim 11 in which the guide comprises one or more ribs aligned in a direction of insertion of the token.

13. The mechanism of claim 12 in which the one or more ribs consist of two portions separated by a clearance to allow the guide to pass therethrough.

14. The mechanism of claim 13 including a pair of ribs.

15. The mechanism of claim 11 in which a rib is disposed above a token insertion slot in communication with the token receptacle.

16. The mechanism of claim 11 in which the boss is provided with a sharp edge facing the token.

17. The mechanism of claim 11 in which the token has a straight edge and the guide comprises a straight edge of the token receptacle.

18. A rotary coin mechanism comprising a rotatable token carrier having a token receptacle, for receiving a token and conveying the token about a rotational path commencing at a token insertion slot and terminating at a dispensing point, the token receptacle having a guide for maintaining the token in a designated orientation within the token receptacle, and a boss extending into the rotational path of the token, whereby when a token is seated in the token receptacle the boss impinges against the token to thereby arrest rotation of the token carrier unless the token is provided with a groove through which the boss can pass as the token is conveyed past the boss.

19. The mechanism of claim 18 in which the guide comprises one or more ribs aligned in a direction of insertion of the token.

20. The mechanism of claim 19 in which the one or more ribs consist of two portions separated by a clearance to allow the guide to pass therethrough.

21. The mechanism of claim 20 including a pair of ribs.

22. The mechanism of claim 18 in which a rib is disposed above a token insertion slot in communication with the token receptacle.

23. The mechanism of claim 18 in which the groove comprises a first groove portion in alignment with the boss and a second groove portion offset from the first groove portion and connected thereto by a cam surface, whereby as the boss passes from the first groove portion to the second groove portion the boss lifts the token at a point of measurement by a perimeter measuring device.

24. The mechanism of claim 18 in which the boss is provided with a sharp edge facing the token.

25. The mechanism of claim 18 in which the token has a straight edge and the guide comprises a straight edge of the token receptacle.

26. A token for use with a rotary coin mechanism comprising a rotatable token carrier having a token receptacle for receiving a token and conveying the token about a rotational path commencing at a coin slot and terminating at a dispensing point, and a boss extending into the rotational path of the token, the token having one or more grooves extending across a face of the token, through which the boss can pass as the token is conveyed past the boss so that the token carrier can be rotated about the rotational path when the token is seated in the token receptacle, the groove comprising a first groove portion in alignment with the boss and a second groove portion offset from the first groove portion and connected thereto by a cam surface, whereby as the boss passes from the first groove portion to the second groove portion the boss lifts the token at a point of measurement by a perimeter measuring device.

* * * * *